US010197348B2

(12) United States Patent
DeSomma

(10) Patent No.: US 10,197,348 B2
(45) Date of Patent: Feb. 5, 2019

(54) ADJUSTABLE GAS BLOCK SYSTEM

(71) Applicant: Frank L. DeSomma, Glendale, AZ (US)

(72) Inventor: Frank L. DeSomma, Glendale, AZ (US)

(73) Assignee: PATRIOT ORDNANCE FACTORY, INC., Phoenix, AZ (US)

( * ) Notice: Subject to any disclaimer, the term of this patent is extended or adjusted under 35 U.S.C. 154(b) by 0 days.

(21) Appl. No.: 15/002,382

(22) Filed: Jan. 20, 2016

(65) Prior Publication Data

US 2016/0209138 A1 Jul. 21, 2016

Related U.S. Application Data

(60) Provisional application No. 62/105,720, filed on Jan. 20, 2015.

(51) Int. Cl.
*F41A 5/28* (2006.01)

(52) U.S. Cl.
CPC ..... *F41A 5/28* (2013.01)

(58) Field of Classification Search
CPC ..... F41A 5/00; F41A 5/18; F41A 5/24; F41A 5/26; F41A 5/28; F41A 5/30
USPC ..... 89/191.01, 191.02, 192, 193
See application file for complete search history.

(56) References Cited

U.S. PATENT DOCUMENTS 1,290,853 A 1/1919 Sturgeon
1,352,414 A 9/1920 Payne
1,357,208 A 10/1920 Payne
1,402,459 A 1/1922 Gustaf
1,738,501 A 12/1929 Moore
1,789,835 A 1/1931 Pedersen
1,879,603 A 9/1932 Coupland
1,912,757 A 6/1933 Brump
2,102,622 A 12/1937 Green
2,110,165 A 3/1938 Moore
2,116,141 A 5/1938 Browning
2,124,075 A 7/1938 Moore
2,287,066 A 6/1942 Rogers
2,391,864 A 1/1946 Chandler
(Continued)

OTHER PUBLICATIONS

USPTO; Restriction Requirement dated Jul. 25, 2007 in U.S. Appl. No. 11/056,306.

(Continued)

*Primary Examiner* — Jonathan C Weber
(74) *Attorney, Agent, or Firm* — Snell & Wilmer, L.L.P.

(57) ABSTRACT

In various embodiments, a rotating bolt firearm may comprise an upper receiver assembly. The upper receiver assembly may comprise an upper receiver, a bolt, a barrel, and an operating system. The bolt may be installable in the upper receiver. The bolt may be moveable between a first position and a second position. The barrel may be operatively coupled to the upper receiver. The barrel may be configured to receive a forward portion of the bolt. The operating system may comprise a gas block, an adjustment, and a spring loaded detent assembly. The adjustment may comprise a threaded portion and a plurality of notches. The spring loaded detent assembly may be configured to selectively engage one of the plurality of notches in response to rotating the adjustment. The operating system may be configured to adjustably vary a gas pressure in the operating system.

15 Claims, 10 Drawing Sheets

(56) References Cited

U.S. PATENT DOCUMENTS 2,437,548 A 3/1948 William
2,467,372 A 4/1949 De Permentier
2,482,880 A 9/1949 Sefried
2,570,292 A 10/1951 Umsted
2,816,484 A 12/1957 Grages
2,935,912 A 5/1960 Hartley
3,051,057 A 8/1962 Ivy
3,071,225 A 1/1963 Blau et al.
3,118,243 A 1/1964 Manshel
3,301,133 A 1/1967 Sturtevant
3,455,204 A 7/1969 Stoner
3,675,534 A 7/1972 Beretta
3,724,325 A 4/1973 Silsby
3,736,693 A 6/1973 Koch
3,908,214 A 9/1975 Doloreto
3,943,821 A 3/1976 Seifried
4,057,924 A * 11/1977 Joseph ..... F41A 21/48 42/75.01
4,244,273 A * 1/1981 Langendorfer, Jr. ..... F41A 5/28 89/193
4,246,830 A 1/1981 Krieger
4,521,985 A 6/1985 Smith et al.
4,536,982 A 8/1985 Bredbury
4,576,083 A 3/1986 Seberger
H107 H 8/1986 Bauer
D285,236 S 8/1986 Brunton
4,651,455 A 3/1987 Geiser
4,658,702 A 4/1987 Tatro
4,663,875 A 5/1987 Tatro
4,759,144 A 7/1988 Egan et al.
4,765,224 A 8/1988 Morris
4,937,964 A 7/1990 Crandall
D329,078 S 9/1992 Hasselbusch
5,183,959 A 2/1993 McCoan et al.
5,272,956 A * 12/1993 Hudson ..... F41A 5/28 42/72
5,343,650 A 9/1994 Swan
5,351,598 A 10/1994 Schuetz
5,386,659 A 2/1995 Vaid et al.
5,479,737 A 1/1996 Osborne et al.
5,543,787 A 8/1996 Karidis et al.
5,551,179 A 9/1996 Young
5,590,484 A 1/1997 Mooney
5,634,288 A 6/1997 Martel
5,726,377 A 3/1998 Harris et al.
5,770,814 A 6/1998 Ealovega
D399,914 S 10/1998 Walker
5,827,992 A 10/1998 Harris et al.
5,930,935 A 8/1999 Griffin
5,983,774 A 11/1999 Mihaita
6,070,352 A 6/2000 Daigle
6,113,285 A 9/2000 Ward
6,209,250 B1 4/2001 Mills
6,217,205 B1 4/2001 Ward
D447,791 S 9/2001 Robidoux
6,308,448 B1 10/2001 Kapusta et al.
6,345,460 B2 2/2002 Hashman
6,347,474 B1 2/2002 Wolff
D462,105 S 8/2002 Myers
6,470,615 B1 10/2002 Peterken
6,490,822 B1 12/2002 Swan
6,508,027 B1 1/2003 Kim
6,508,159 B1 1/2003 Muirhead
D477,855 S 7/2003 Selvaggio
6,606,812 B1 8/2003 Gwinn
6,634,274 B1 10/2003 Herring
6,681,677 B2 1/2004 Herring
6,694,660 B1 2/2004 Davies
6,722,072 B1 4/2004 McCormick et al.
6,722,255 B2 4/2004 Herring
6,779,288 B1 8/2004 Kim
6,827,130 B2 12/2004 Larson
6,839,998 B1 1/2005 Armstrong
6,848,351 B1 2/2005 Davies
6,854,206 B2 2/2005 Oz
D504,168 S 4/2005 McCormick
6,921,181 B2 7/2005 Yen
6,971,202 B2 12/2005 Bender
7,051,467 B1 5/2006 Huber
7,131,228 B2 11/2006 Hochstrate et al.
D544,063 S 6/2007 Swan
7,316,091 B1 1/2008 Desomma
7,363,741 B2 4/2008 Desomma
7,418,898 B1 9/2008 Desomma
7,421,937 B1 9/2008 Gangl
7,464,496 B1 12/2008 Davies
D590,473 S 4/2009 Fitzpatrick et al.
D593,617 S 6/2009 Dochterman
7,584,567 B1 9/2009 Desomma
7,600,338 B2 10/2009 Geissele
D604,793 S 11/2009 Fitzpatrick et al.
7,753,679 B1 7/2010 Schuetz
7,784,211 B1 8/2010 Desomma
D624,609 S 9/2010 Stein et al.
7,798,045 B1 9/2010 Fitzpatrick et al.
7,827,722 B1 11/2010 Davies
D629,062 S 12/2010 Peterson et al.
7,856,917 B2 * 12/2010 Noveske ..... F41A 5/28 89/193
D630,698 S 1/2011 Peterson et al.
D631,933 S 2/2011 Thompson
7,891,284 B1 * 2/2011 Barrett ..... F41A 5/28 89/14.4
7,905,041 B1 3/2011 Davies
7,930,968 B2 4/2011 Giefing
D643,086 S 8/2011 Peterson et al.
D645,532 S 9/2011 Peterson et al.
8,056,460 B2 11/2011 Herring
8,091,265 B1 1/2012 Teetzel
8,161,864 B1 * 4/2012 Vuksanovich ..... F41A 5/26 89/191.01
8,230,634 B1 7/2012 Davies
8,261,653 B2 * 9/2012 Crommett ..... F41A 5/28 89/191.01
8,359,966 B1 1/2013 Brotherton
8,381,628 B1 2/2013 Wheatly
8,479,428 B1 7/2013 Desomma
D708,693 S 7/2014 Faxon
D713,483 S 9/2014 Firpo
8,826,797 B2 9/2014 Overstreet
D716,404 S 10/2014 Capps
8,863,637 B2 * 10/2014 Hall ..... F41A 19/03 89/129.01
8,869,674 B2 * 10/2014 Ruck ..... F41A 5/28 89/193
D717,904 S 11/2014 Oglesby
8,875,614 B2 * 11/2014 Gomez ..... F41A 5/28 89/193
D720,032 S 12/2014 Boutin
8,910,406 B1 12/2014 Huang
8,978,282 B2 3/2015 Garrett
9,032,860 B2 5/2015 Faxon
D741,978 S 10/2015 Shea
9,194,638 B2 11/2015 Larson et al.
D745,621 S 12/2015 Huang
D748,754 S 2/2016 Chastain
D750,725 S 3/2016 Capps
9,291,412 B1 3/2016 Montes
9,303,949 B1 4/2016 Oglesby
D755,339 S 5/2016 Geissele
D757,199 S 5/2016 Bender
D760,860 S 7/2016 Vincent
D763,397 S 8/2016 Huang
D764,004 S 8/2016 Bender
9,423,194 B2 8/2016 Fritz
9,429,375 B2 8/2016 DeSomma
D768,801 S 10/2016 Morris
D771,767 S 11/2016 Niswander
9,523,557 B2 12/2016 Sharron
9,523,558 B2 12/2016 Visinski
9,528,793 B1 12/2016 Oglesby
D777,285 S 1/2017 Bender
2003/0010186 A1 1/2003 Muirhead
2003/0010187 A1 1/2003 Muirhead

(56) References Cited

U.S. PATENT DOCUMENTS

| | | | | |
|---|---|---|---|---|
| 2004/0064994 | A1 | 4/2004 | Luke | |
| 2004/0226212 | A1 | 11/2004 | Shiloni | |
| 2005/0000142 | A1 | 1/2005 | Kim et al. | |
| 2005/0223613 | A1 | 10/2005 | Bender | |
| 2005/0241211 | A1 | 11/2005 | Swan | |
| 2005/0262752 | A1 | 12/2005 | Robinson et al. | |
| 2005/0262997 | A1 | 12/2005 | Brixius | |
| 2006/0026883 | A1 | 2/2006 | Hochstrate et al. | |
| 2006/0010748 | A1 | 6/2006 | Stoner et al. | |
| 2006/0236582 | A1 | 10/2006 | Lewis et al. | |
| 2006/0265925 | A1 | 11/2006 | Murello | |
| 2006/0265926 | A1 | 11/2006 | Sietsema | |
| 2006/0277810 | A1 | 12/2006 | Leitner-Wise | |
| 2007/0006509 | A1 | 1/2007 | Desomma | |
| 2007/0033851 | A1 | 2/2007 | Hochstrate et al. | |
| 2007/0051236 | A1 | 3/2007 | Groves et al. | |
| 2007/0079539 | A1 | 4/2007 | Karagias | |
| 2007/0180984 | A1 | 8/2007 | Huther | |
| 2007/0199435 | A1 | 8/2007 | Hochstrate et al. | |
| 2007/0169393 | A1 | 12/2007 | Frost | |
| 2008/0078284 | A1 | 4/2008 | Murello | |
| 2009/0223357 | A1 | 9/2009 | Herring | |
| 2009/0249672 | A1 | 10/2009 | Zedrosser | |
| 2009/0313873 | A1 | 12/2009 | Roth | |
| 2010/0000400 | A1 | 1/2010 | Brown | |
| 2010/0251591 | A1 | 10/2010 | Burt | |
| 2010/0319231 | A1 | 12/2010 | Stone et al. | |
| 2010/0319527 | A1 | 12/2010 | Giefing | |
| 2011/0000119 | A1 | 1/2011 | Desomma | |
| 2011/0016762 | A1 | 1/2011 | Davies | |
| 2011/0056107 | A1 | 3/2011 | Underwood | |
| 2011/0214327 | A1 | 9/2011 | Desomma | |
| 2011/0271827 | A1 | 11/2011 | Larson | |
| 2011/0283580 | A1 | 11/2011 | Esch | |
| 2012/0117845 | A1 | 5/2012 | Desomma | |
| 2012/0167757 | A1* | 7/2012 | Gomez | F41A 5/28 89/193 |
| 2012/0174451 | A1 | 7/2012 | Overstreet | |
| 2012/0260793 | A1 | 10/2012 | Gomez | |
| 2012/0297656 | A1 | 11/2012 | Langevin | |
| 2013/0098235 | A1* | 4/2013 | Reinken | F41A 5/28 89/193 |
| 2013/0174721 | A1* | 7/2013 | Langevin | F41G 1/033 89/193 |
| 2013/0219763 | A1 | 8/2013 | Nunes | |
| 2013/0220295 | A1 | 8/2013 | Wood et al. | |
| 2013/0227869 | A1 | 9/2013 | Thordsen | |
| 2014/0000142 | A1 | 1/2014 | Patel | |
| 2014/0060312 | A1* | 3/2014 | Ruck | F41A 5/28 89/193 |
| 2014/0075804 | A1 | 3/2014 | Langevin | |
| 2014/0076149 | A1* | 3/2014 | Adams | F41A 5/28 89/192 |
| 2014/0224114 | A1 | 8/2014 | Faxon | |
| 2014/0260945 | A1 | 9/2014 | Desomma | |
| 2014/0311007 | A1 | 10/2014 | Capps | |
| 2014/0352191 | A1 | 12/2014 | Fritz | |
| 2015/0007476 | A1 | 1/2015 | Dextraze | |
| 2015/0040455 | A1 | 2/2015 | Lewis | |
| 2015/0198409 | A1 | 7/2015 | Desomma | |
| 2015/0226501 | A1 | 8/2015 | Gibbens | |
| 2015/0253091 | A1* | 9/2015 | Gardner | F41A 5/28 89/193 |
| 2015/0323269 | A1 | 11/2015 | McGinty | |
| 2015/0330733 | A1 | 11/2015 | Desomma | |
| 2015/0345879 | A1 | 12/2015 | Jen | |
| 2015/0362270 | A1 | 12/2015 | Stewart | |
| 2015/0369558 | A1 | 12/2015 | Gottzmann | |
| 2016/0209137 | A1 | 7/2016 | DeSomma | |
| 2016/0178297 | A1 | 12/2016 | Sharps | |
| 2017/0051989 | A1 | 2/2017 | DeSomma | |
| 2017/0153075 | A1 | 6/2017 | DeSomma | |

OTHER PUBLICATIONS

USPTO; Non-Final Office Action dated Oct. 10, 2007 in U.S. Appl. No. 11/056,306.
USPTO; Notice of Allowance dated May 9, 2008 in U.S. Appl. No. 11/056,306.
USPTO; Restriction Requirement dated Nov. 15, 2006 in U.S. Appl. No. 11/174,270.
USPTO; Non-Final Office Action dated Mar. 15, 2007 in U.S. Appl. No. 11/174,270.
USPTO; Final Office Action dated Sep. 26, 2007 in U.S. Appl. No. 11/174,270.
USPTO; Notice of Allowance dated Jan. 14, 2008 in U.S. Appl. No. 11/174,270.
USPTO; Non-Final Office Action dated Jan. 18, 2007 in U.S. Appl. No. 11/232,521.
USPTO; Final Office Action dated Jun. 15, 2007 in U.S. Appl. No. 11/232,521.
USPTO; Notice of Allowance dated Aug. 15, 2007 in U.S. Appl. No. 11/232,521.
USPTO; Non-Final Office Action dated Apr. 29, 2008 in U.S. Appl. No. 11/442,035.
USPTO; Notice of Allowance dated Sep. 30, 2008 in U.S. Appl. No. 11/442,035.
USPTO; Non-Final Office Action dated Dec. 27, 2007 in U.S. Appl. No. 11/527,851.
USPTO; Final Office Action dated Aug. 13, 2008 in U.S. Appl. No. 11/527,851.
USPTO; Non-Final Office Action dated Mar. 3, 2009 in U.S. Appl. No. 11/527,851.
USPTO; Final Office Action dated Sep. 1, 2009 in U.S. Appl. No. 11/527,851.
USPTO; Notice of Allowance dated Mar. 29, 2013 in U.S. Appl. No. 11/527,851.
USPTO; Non-Final Office Action dated Dec. 14, 2009 in U.S. Appl. No. 11/947,294.
USPTO; Notice of Allowance dated May 5, 2010 in U.S. Appl. No. 11/947,294.
USPTO; Non-Final Office Action dated Dec. 11, 2008 in U.S. Appl. No. 12/110,304.
USPTO; Notice of Allowance dated May 29, 2009 in U.S. Appl. No. 12/110,304.
USPTO; Non-Final Office Action dated Nov. 24, 2010 in U.S. Appl. No. 12/489,592.
USPTO; Notice of Allowance dated Mar. 3, 2011 in U.S. Appl. No. 12/489,592.
USPTO; Non-Final Office Action dated Feb. 17, 2013 in U.S. Appl. No. 12/497,048.
USPTO; Non-Final Office Action dated Feb. 15, 2012 in U.S. Appl. No. 13/098,196.
USPTO; Final Office Action dated Jun. 11, 2012 in U.S. Appl. No. 13/098,196.
USPTO; Non-Final Office Action dated Feb. 21, 2012 in U.S. Appl. No. 13/105,893.
USPTO; Final Office Action dated Apr. 13, 2012 in U.S. Appl. No. 13/105,893.
USPTO; Advisory Action dated Apr. 26, 2012 in U.S. Appl. No. 13/105,893.
USPTO; Notice of Allowance dated Jun. 22, 2012 in U.S. Appl. No. 13/105,893.
USPTO; Non-Final Office Action dated Feb. 15, 2012 in U.S. Appl. No. 13/358,347.
USPTO; Non-Final Office Action dated Jun. 6, 2012 in U.S. Appl. No. 13/358,347.
USPTO; Non-Final Office Action dated Feb. 27, 2013 in U.S. Appl. No. 13/708,025.
USPTO; Final Office Action dated Sep. 26, 2013 in U.S. Appl. No. 13/708,025.

(56) References Cited

OTHER PUBLICATIONS

USPTO; Non-Final Office Action dated Dec. 17, 2013 in U.S. Appl. No. 13/835,842.
USPTO; Final Office Action dated Jun. 4, 2014 in U.S. Appl. No. 13/835,842.
USPTO; Non-Final Office Action dated Oct. 24, 2014 in U.S. Appl. No. 13/835,842.
USPTO; Final Office Action dated Jun. 18, 2015 in U.S. Appl. No. 13/835,842.
USPTO; Non-Final Office Action dated Jan. 5, 2016 in U.S. Appl. No. 13/835,842.
USPTO; Final Office Action dated Jun. 1, 2016 in U.S. Appl. No. 13/835,842.
USPTO; Non-Final Office Action dated Jan. 29, 2015 in U.S. Appl. No. 14/216,733.
USPTO; Final Office Action dated Jul. 16, 2015 in U.S. Appl. No. 14/216,733.
USPTO; Non-Final Office Action dated Jan. 14, 2016 in U.S. Appl. No. 14/527,698.
USPTO; Notice of Allowance dated Apr. 25, 2016 in U.S. Appl. No. 14/527,698.
USPTO; Non-Final Office Action dated Aug. 17, 2015 in U.S. Appl. No. 14/596,018.
USPTO; Non-Final Office Action dated Jun. 23, 2016 in U.S. Appl. No. 15/002,096.
USPTO; Restriction Requirement dated Apr. 24, 2014 in U.S. Appl. No. 29/449,556.
USPTO; Notice of Allowance dated Jul. 7, 2014 in U.S. Appl. No. 29/449,556.
USPTO; Notice of Allowance dated Oct. 13, 2015 in U.S. Appl. No. 29/502,433.
POF-USA Patriot Ordnance Factory, Inc., Upper Receiver web page, Retrieved from http://web.archive.org/web/20100922070336/http://www.pof-usa.com/upper/upperreceiver,html[Sep. 17, 2012 9:19:17 AM].
USPTO; Non-Final Office Action dated Dec. 1, 2016 in U.S. Appl. No. 13/835,842.
USPTO; Final Office Action dated Dec. 27, 2016 in U.S. Appl. No. 15/002,096.
USPTO; Notice of Allowance dated Jan. 11, 2017 in U.S. Appl. No. 29/551,847.
Rainer Arms Forged Mil-Spec Upper Minus FA 9mm / .22 LR, RainierArms.com, [online], [site visited Dec. 30, 2016]. <URL: http://www.rainierarms.com/rainier-arms-forged-mil-spec-upper-minus-fa-22-lr>.
Rainer Arms Forged A4 Upper Receiver-GEN2, RainierArms.com, [online], [site visited Dec. 30, 2016]. <URL: http://www.rainierarms.com/rainier-arms-forged-A4-upper-receiver-gen2>.
Rainer Arms Forged Mil-Spec Upper Minus FA 1/LOGO, RainierArms.com, [online], [site visited Dec. 30, 2016]. <URL: http://www.rainierarms.com/rainier-arms-forged-mil-spec-upper-minus-fa-w-logo>.
BCM M4 Arms Upper Receiver Assembly, RainierArms.com, [online], [site visited Dec. 30, 2016]. <URL: http://www.rainierarms.com/bcm-m4-upper-receiver-assembly>.
NorthTech Defense Non Forward Assist AR15 Billet Upper Receiver, RainierArms.com, [online], [site visited Dec. 30, 2016]. <URL: http://www.rainierarms.com/northtech-defense-non-forward-assist-ar15-billet-upper-receiver>.
SAAAR 15 Stripped Flat Top Upper Receiever—No Mark, SurplusAmmo.com, [online], [site visited Dec. 30, 2016]. <URL: http://www.surplusammo.com/saa-ar15-stripped-flat-top-upper-receiver-no-mark/>.
Aero Precision Assembled AR-15 Upper receiever with Port Door and Forward Assist, PrimaryArms.com, [online], [site visited Dec. 30, 2016]. URL: http://www.primaryarms.com/aero-precision-assembled-ar-15-upper-receiver-with-port-door-and-forward-assist-ap501603-asmbly>.
Anderson Manufacturing AR-15 Stripped Upper Receiver, PrimaryArms.com, [online], [site visited Dec. 30, 2016]. <URL: http://www.primaryarms.com/anderson-manufacturing-ar-15-stripped-upper-receiver-ar-15-a3-upfor-um>.
Vltor MUR Modular Upper Receiver with Shell Deflector Only Assembled AR-15 Matte, MidwayUSA.com, [online], [site visited Dec. 30, 2016]. <URL: http://www.midwayusa.com/product/478529/vltor-mur-modular-upper-receiver-with-shell-deflector-only-assembled-ar-15-matte>.
LanTac USA LA00221 AR-15 UAR Stripped Upper Receiver 5.56mm Black, TombStoneTactical.com, [online], [site visited Dec. 13, 2016]. <URL: http://www.tombstonetactical.com/catalog/lantac-usa/la00221-ar15-uar-stripped-upper-receiver-5.56mm-black/>.
AR15-A3 Stripped Upper Receiver, FrederickArms.com, [online], [site visited Dec. 30, 2016]. <URL:http://www.frederickarms.com/ar15-a3-stripped-upper-receiver.html>.
Upper Receiver AR-15, CrossHairCustoms.com, [online], [site visited Dec. 30, 2016]. <URL: http://www.crosshaircustoms.com'/product/ar-15-upper-receiver/>.
USPTO; Notice of Allowance dated Mar. 30, 2017 in U.S. Appl. No. 29/551,237.
USPTO; Non-Final Office Action dated Apr. 10, 2017 in U.S. Appl. No. 15/002,096.
USPTO; Non-Final Office Action dated Jun. 13, 2017 in U.S. Appl. No. 15/250,218.
USPTO; Final Office Action dated Jun. 28, 2017 in U.S. Appl. No. 13/835,842.
USPTO; Final Office Action dated Sep. 28, 2017 in U.S. Appl. No. 15/002,096.
USPTO; Restriction Requirement Office Action dated Oct. 31, 2017 in U.S. Appl. No. 15/410,534.
USPTO; Restriction Requirement Office Action dated Oct. 16, 2017 in U.S. Appl. No. 15/342,981.

* cited by examiner

SECTION A-A

ADJUSTABLE GAS BLOCK SYSTEM

CROSS REFERENCE TO RELATED APPLICATIONS

This application claims priority to and the benefit of U.S. Provisional Application Ser. No. 62/105,720, filed on Jan. 20, 2015 and titled ADJUSTABLE GAS BLOCK SYSTEM, which is hereby incorporated by reference in its entirety for any purpose.

FIELD

The disclosure relates to devices, systems and methods for controlling gas pressure in an AR-15 style rifle operating system.

BACKGROUND

Typical AR-15 gas systems are not adjustable. They are usually configured with set orifices that operate at a single fixed gas pressure. As a result, these typical systems may be unreliable when they are operated with muzzle suppression devices (e.g., suppressors) or non-standard ammunition (e.g., sub-sonic ammunition).

SUMMARY

In various embodiments, a rotating bolt firearm may comprise an upper receiver, a bolt, a barrel, and an operating system. The bolt may be installable in the upper receiver. The bolt may be moveable between a first position and a second position. The barrel may be operatively coupled to the upper receiver. The barrel may be configured to receive a forward portion of the bolt. The operating system may comprise a gas block, an adjustment, and a spring loaded detent assembly. The adjustment may comprise a threaded portion and a plurality of notches. The spring loaded detent assembly may be configured to selectively engage one of the plurality of notches in response to rotating the adjustment. The operating system may be configured to adjustably vary a gas pressure in the operating system.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of various embodiments herein makes reference to the accompanying drawings, which show various embodiments by way of illustration and their best mode. While these various embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

In various embodiments, an AR-15 style rifle may be any suitable pistol or rifle that is modeled after or substantially similar to the design first introduced by Eugene Stoner. The AR-15 style rifle may be a semi-automatic, fully automatic or manual actuated rifle. The AR-15 style rifle may generally comprise an upper receiver operatively coupled to a lower receiver. A barrel may be operatively coupled to the upper receiver. The upper receiver may be configured with a bolt carrier that is configured to translate between a battery position and an out of battery position. The AR-15 style rifle may be generally configured to fire any suitable caliber of ammunition. The AR-15 style rifle may be configured with any suitable actuation system including for example, a gas piston system, a gas impingement system, a manual actuation system, and/or the like.

Figure 1:
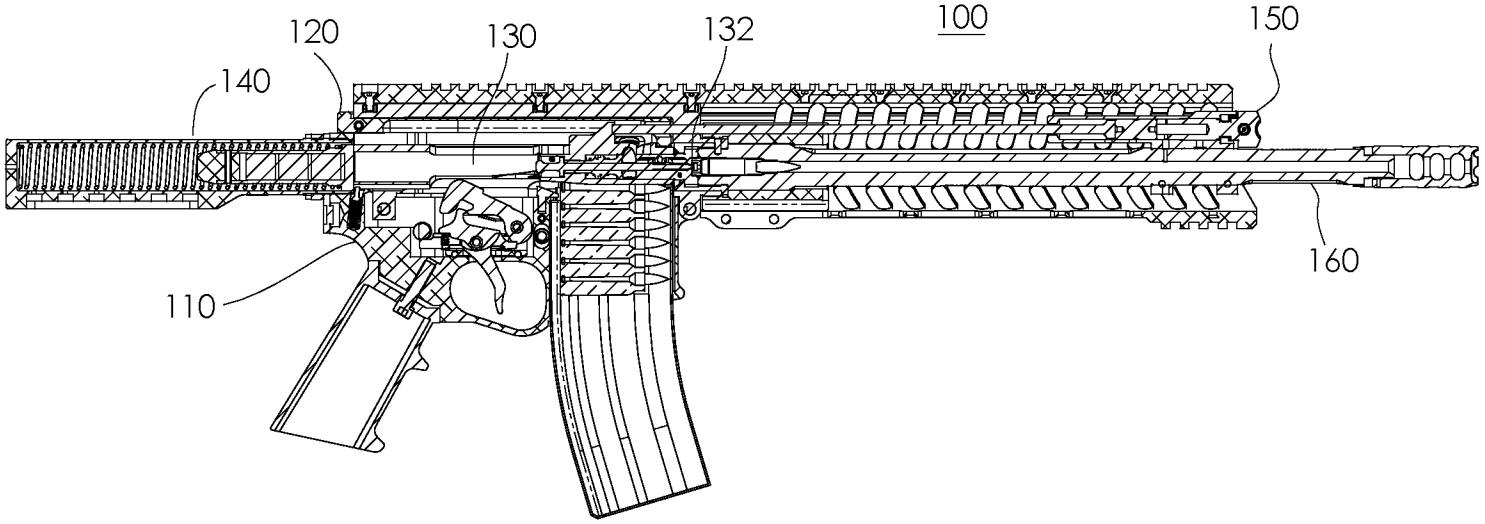
FIG. 1 is a cross-sectional view of an AR-15 style rifle, in accordance with various embodiments.

In various embodiments and with reference to FIG. 1, firearm 100 may comprise a lower receiver 110, an upper receiver 120, a bolt carrier 130, a buffer system 140, an operating system 150, and a barrel 160. Firearm 100 may further comprise various other components including, for example, a handguard, a magazine, a handle, a trigger, and or other suitable components. Upper receiver 120 and lower receiver 110 may operably couple to one another. Bolt carrier 130 may be installable in, and slideably operate in upper receiver 120 in response to receiving an input from operating system 150. Operating system 150 may be any suitable operating system, including for example, a gas piston system (e.g. as is shown in FIG. 1), a direct impingement operating system, a manual operating system and/or the like.

In various embodiments, barrel 160 may be coupled to upper receiver 120. Barrel 160 may be configured to receive a round of ammunition. When bolt carrier 130 is in the battery position, firearm 100 may be configured to fire a round of ammunition through barrel 160. In response to a round of ammunition being fired, operating system 150 may actuate bolt carrier 130 from the battery position to the out of battery position. This actuation from the battery position may cause bolt carrier 130 to travel aft (e.g., away from the direction of fire or away from the muzzle of firearm 100) and cyclically engage buffer system 140.

In various embodiments, firearm 100 may be a rotating bolt firearm (e.g., an AR-15 style piston or direct impingement operated system). A bolt 132 may be located within bolt carrier 130. Bolt 132 may be rotatably moveable between a first position and a second position in response to an input from operating system 150 and or a user engagement of the trigger.

Figure 2:
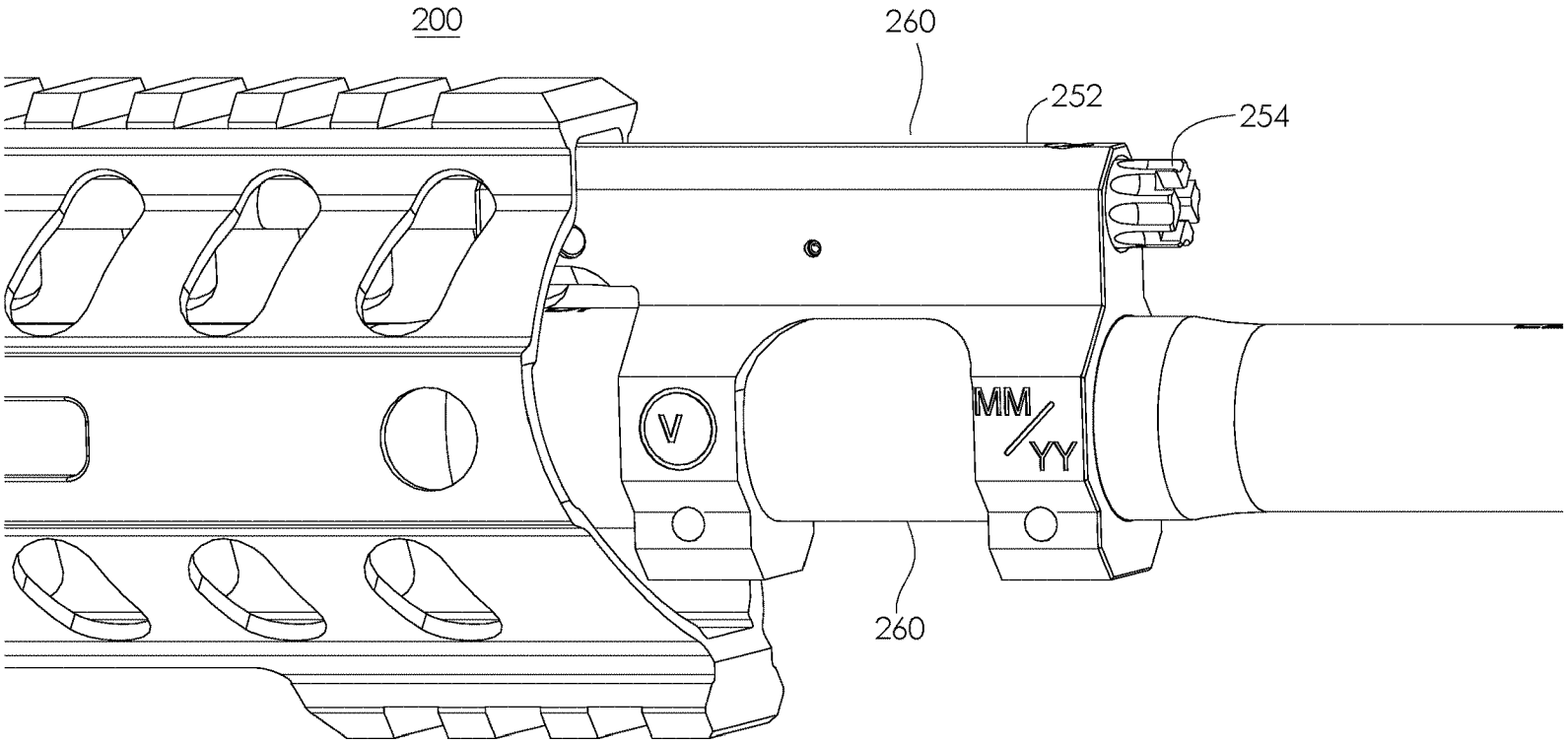
FIG. 2 is a perspective side view of a portion of an AR-15 style rifle comprising an adjustable gas block, in accordance with various embodiments.

In various embodiments and with reference to FIG. 2, operating system 250 may comprise a body 252 and an adjustment knob 254. Operating system 250 may be operably coupled to barrel 260 of firearm 200. Moreover, operating system 250 may be in fluid communication with an internal chamber defined by barrel 260. In this regard, gas from the internal chamber of barrel 260 may be conducted into operating system 250, and more specifically, body 252 allowing firearm 200 to operate when a round of ammunition is fired.

Figure 3A:
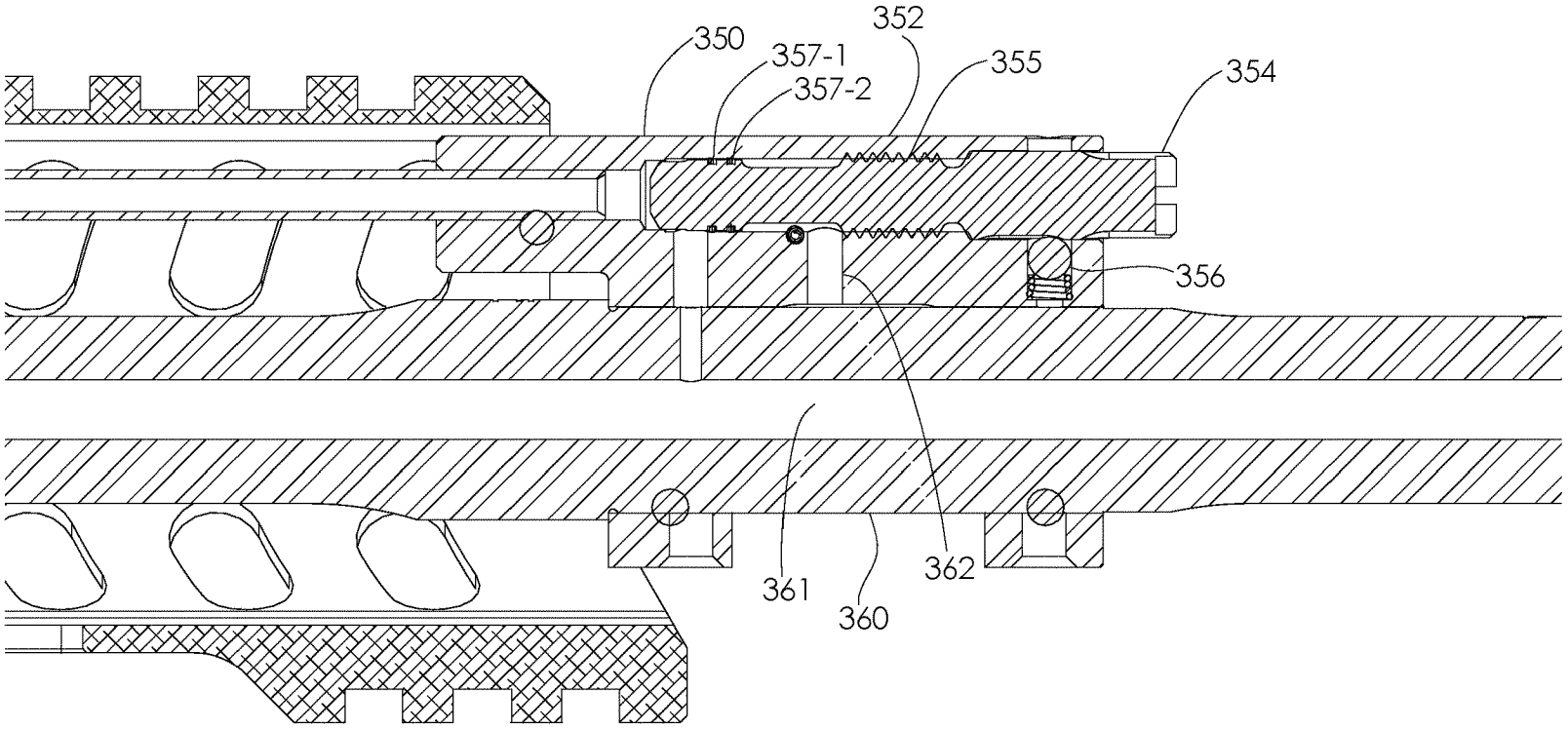
FIG. 3A is a cross-sectional view of a portion of an AR-15 style rifle comprising an adjustable gas block, in accordance with various embodiments.
Figure 3B:
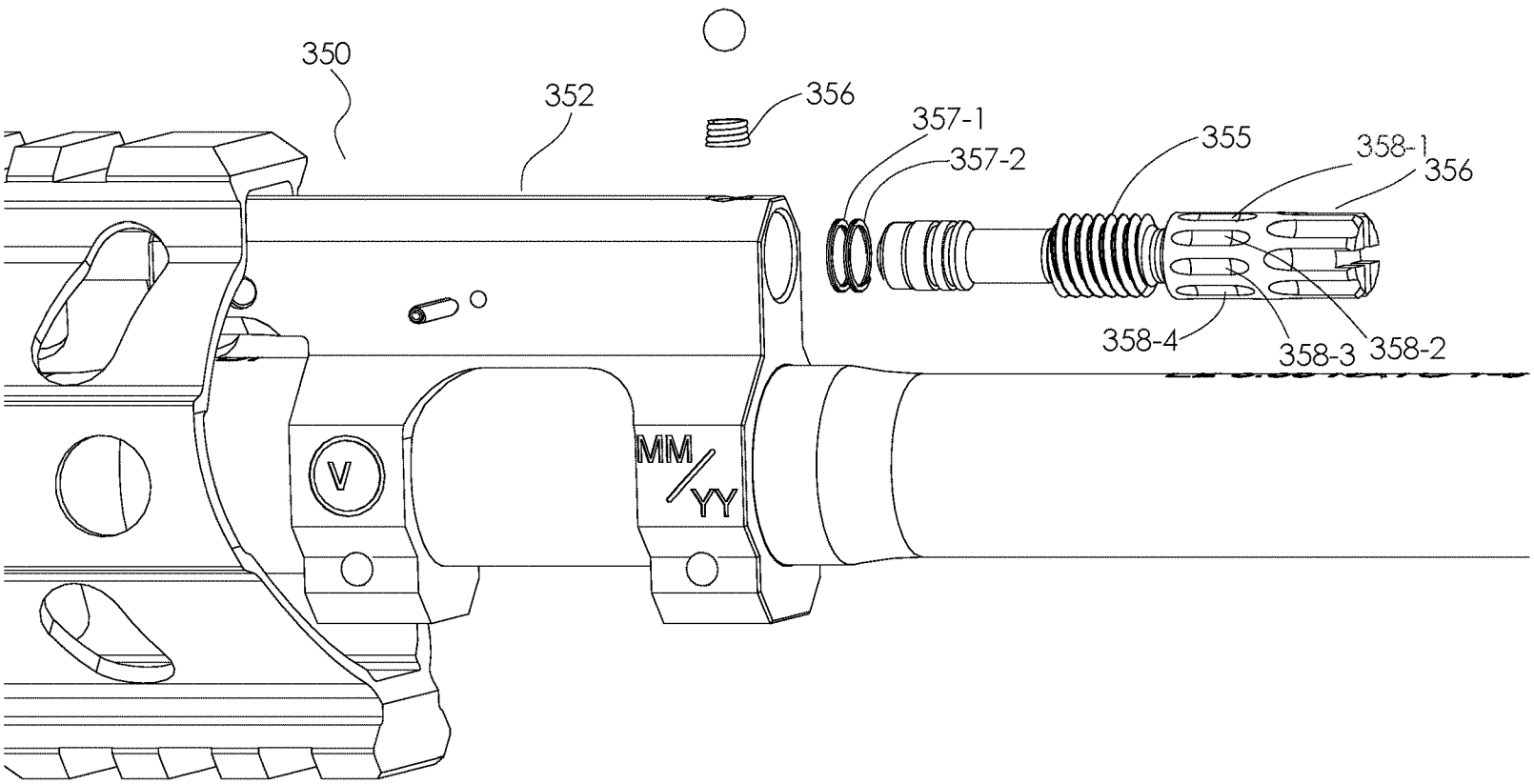
FIG. 3B is an exploded partial perspective view of a portion of an AR-15 style rifle comprising an adjustable gas block, in accordance with various embodiments.

In various embodiments and with reference to FIG. 3A and FIG. 3B, a firearm 300 may comprise an operating system 350 that is adjustable. Operating system 350 may be adjustable by a user. In this regard, the user may engage an adjustment 354 that is installed in body 352. Adjustment 354 may be manipulated and/or turned causing the flow of gas from barrel 360 into body 352 and/or into operating system 350 to vary. The pressure may be varied by varying the size of an orifice and/or channel between barrel 360 and body 352.

In various embodiments, adjustment 354 may be rotatably installable within body 352 of operating system 350. Adjustment 354 may be configured to retain one or more rings 357 (shown as ring 357-1 and ring 357-2 in FIG. 3A and FIG. 3B). One or more rings 357 may engage an internal chamber of operating system 350 and, more specifically, body 352. Moreover, adjustment 354 may comprise a threaded portion 355. In response to a user engaging and/or manipulating adjustment 354, threaded portion 355 may be rotated within operating system 350 and/or body 352 to vary the flow area of gas port 362. Gas port 362 may be a fluid conduit and may establish fluid communication between the internal chamber of the barrel 360 and the internal chamber defined by body 352 of operating system 350. By varying the area of gas port 362, the pressure and rate of cycling or fire of firearm 300 may be adjusted.

In various embodiments, adjustment 354 may comprise a plurality of notches 358, which are shown as notch 358-1, 358-2, 358-3, 358-4, and the like. Body 352 may be further configured to receive a spring loaded detent assembly 356. Spring loaded detent assembly 356 may be configured to engage one or more of the plurality of notches 358. This engagement may occur in response to adjustment 354 being adjusted and/or rotated. Spring loaded detent assembly 356 may engage a first notch in response to a first rotation and a second notch in response to a second rotation. Moreover the plurality of notches 358 may be appropriately spaced and/or sized to correspond to a rotation of threaded portion 355. In this regard, an adjustment of adjustment 354 between a first notch 358-1 and second notch 358-2 may be detectable by the user as spring loaded detent assembly 356 passes between notch 358-1 and notch 358-2. Moreover, the adjustment of the flow area of gas port 362 may be correlated to a position of spring loaded detent assembly 356 to one or more of the plurality of notches and/or one or more rotations of the threaded portion 355 of adjustment 354.

Figure 3C:
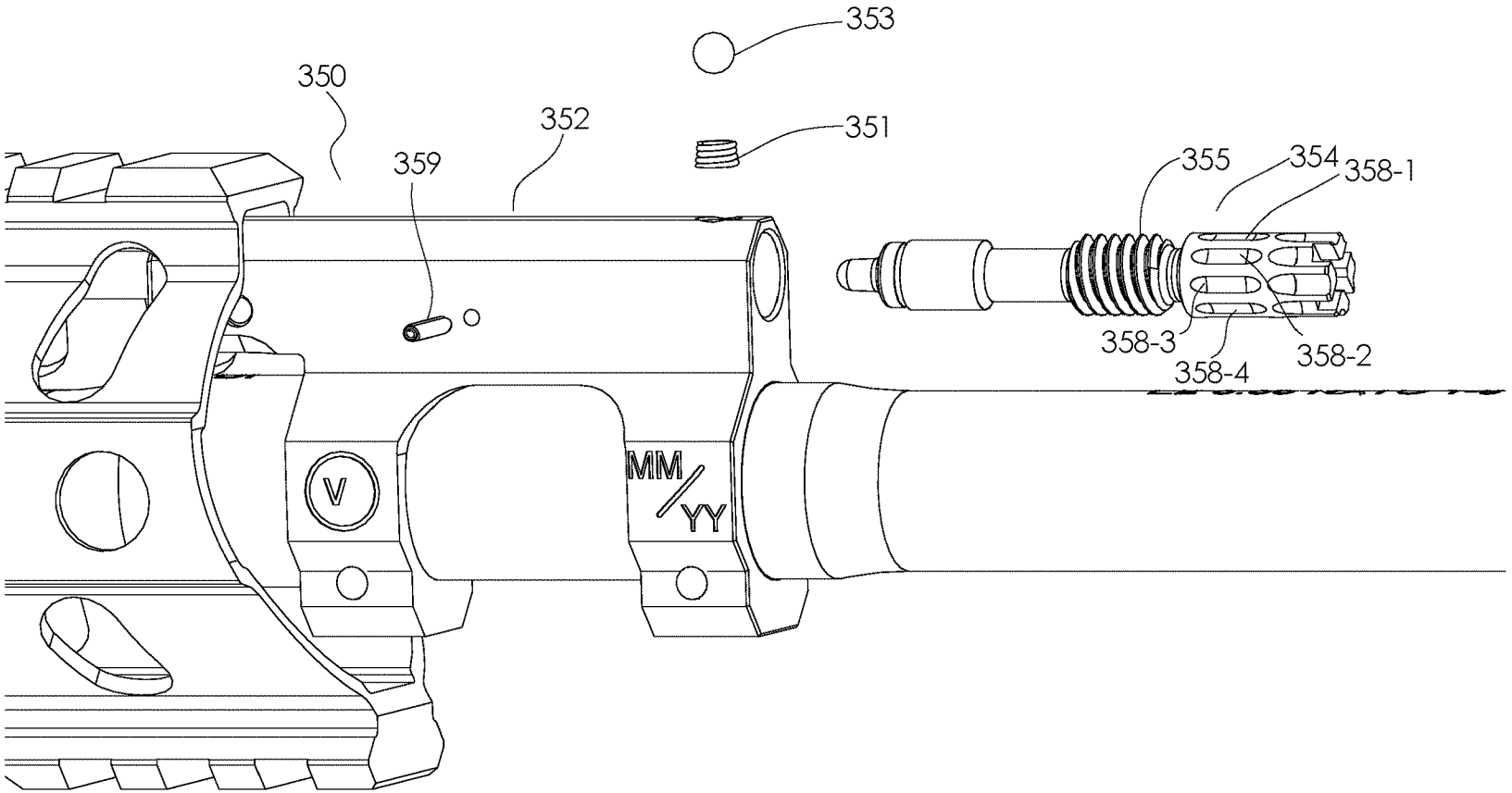
FIG. 3C is a perspective view of a portion of an AR-15 style rifle comprising an adjustable gas block and a pin, in accordance with various embodiments.
Figure 3D:
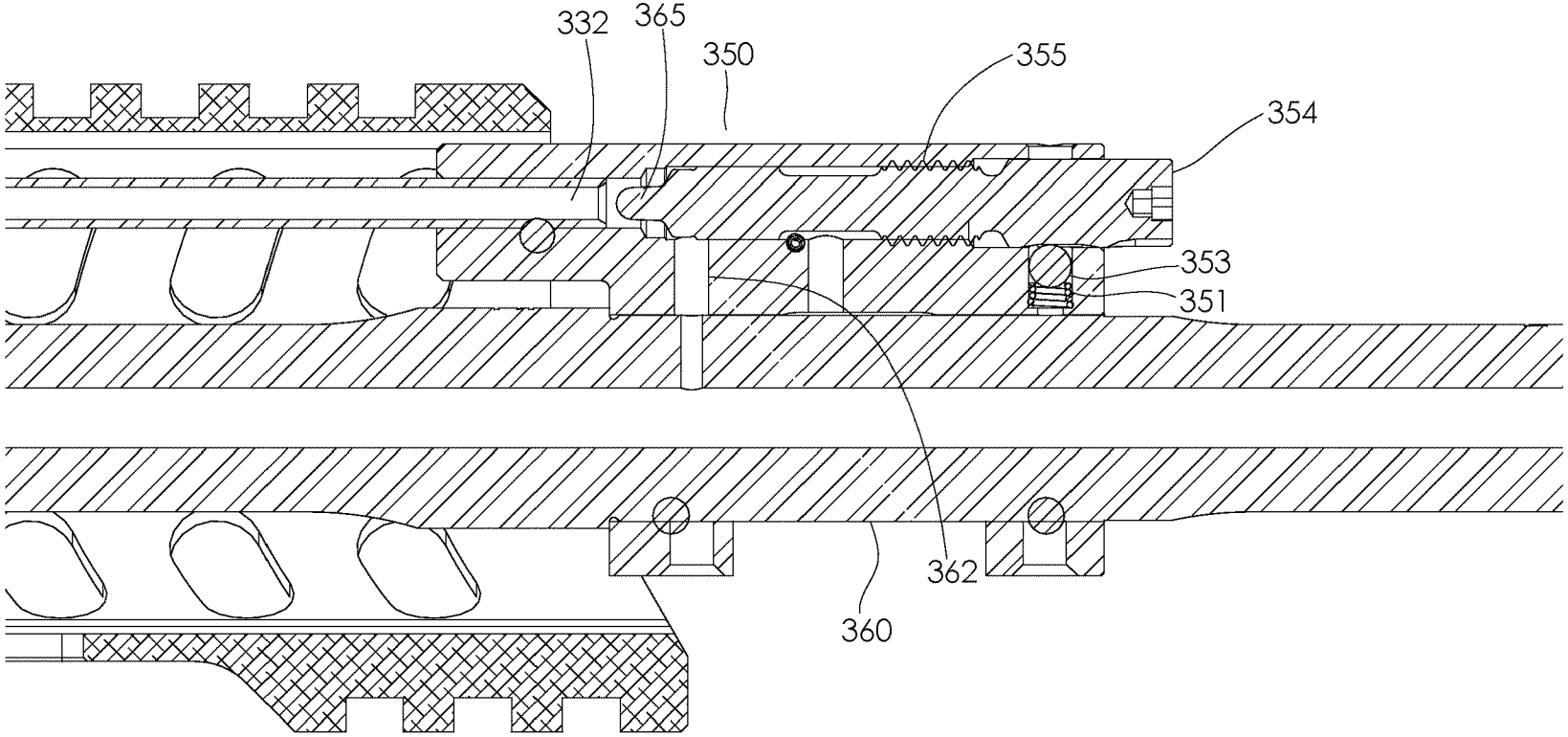
FIG. 3D is a cross-sectional view of a portion of an AR-15 style rifle comprising an adjustable gas block, in accordance with various embodiments.
Figure 4A:
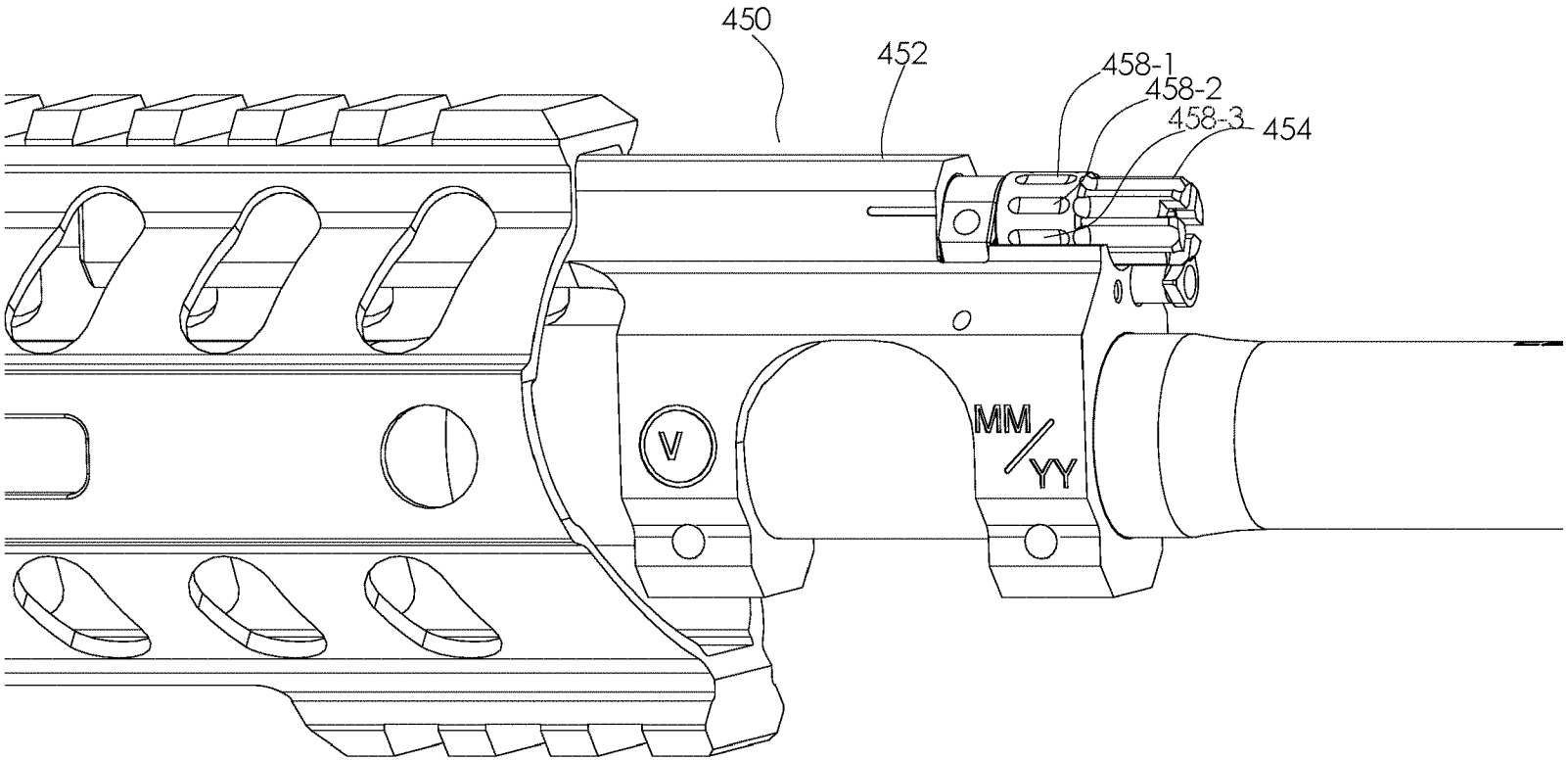
FIG. 4A is a perspective view of a portion of an AR-15 style rifle comprising an adjustable gas block, in accordance with various embodiments.
Figure 4B:
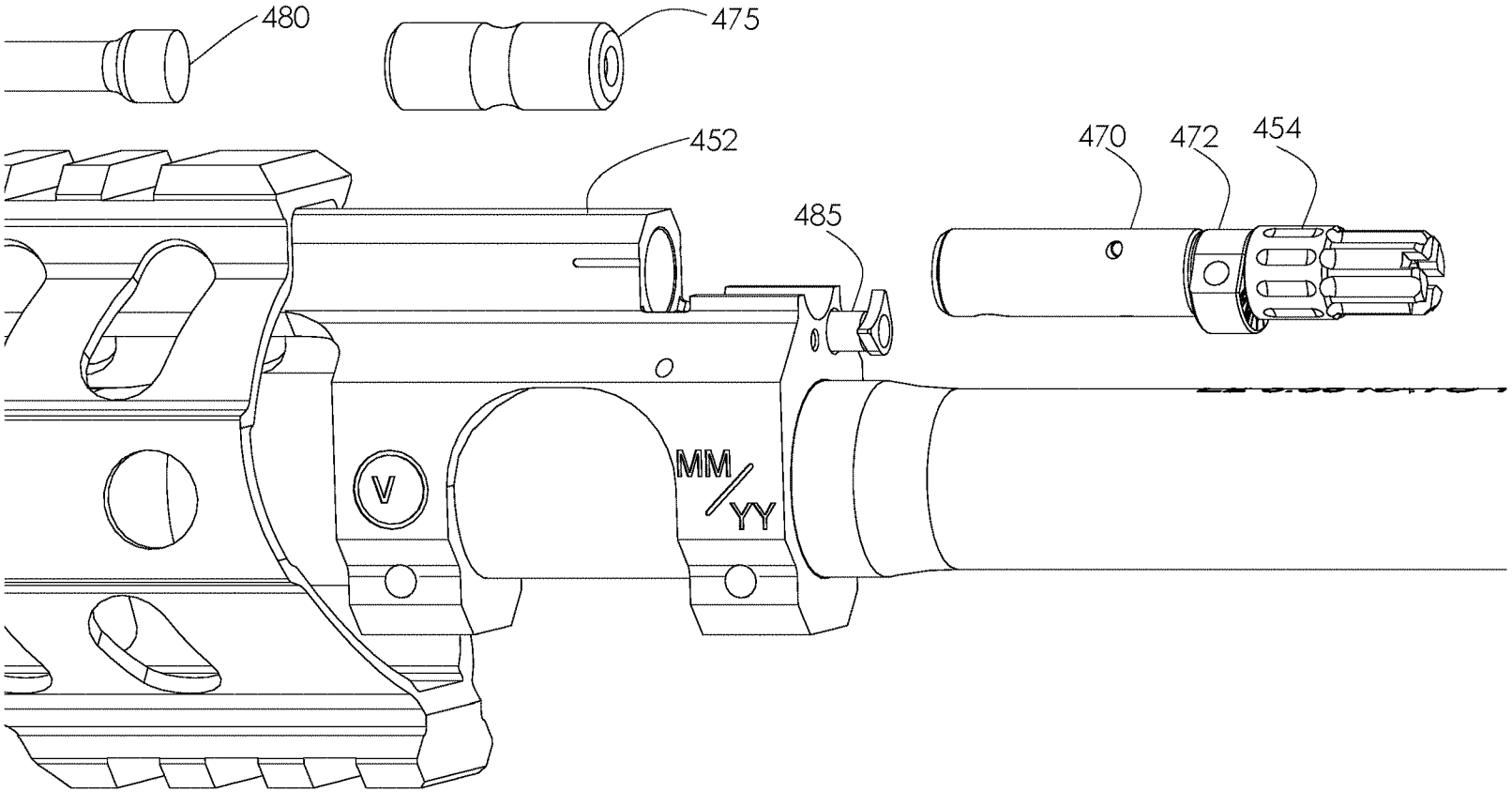
FIG. 4B is a perspective view, exploded of a portion of an AR-15 style rifle comprising an adjustable gas block, in accordance with various embodiments.
Figure 4C:
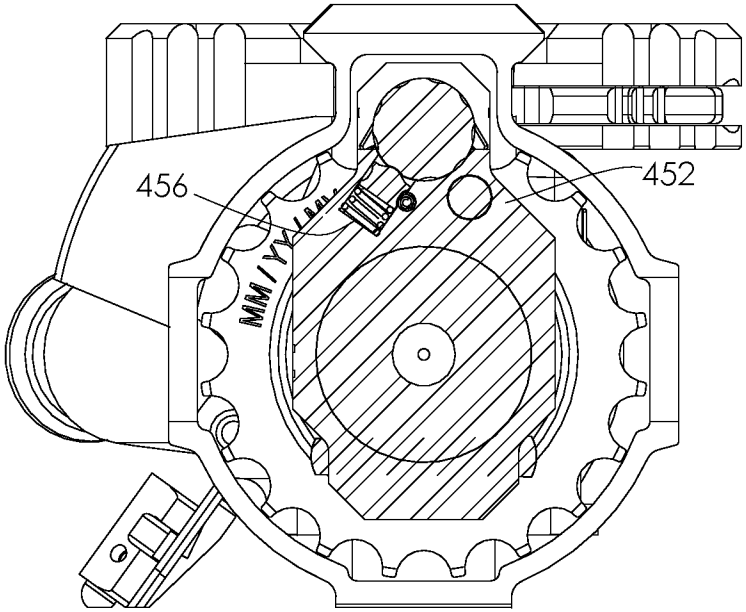
FIG. 4C is a front, cross-sectional view of a portion of an AR-15 style rifle comprising an adjustable gas block, in accordance with various embodiments.
Figure 4D:
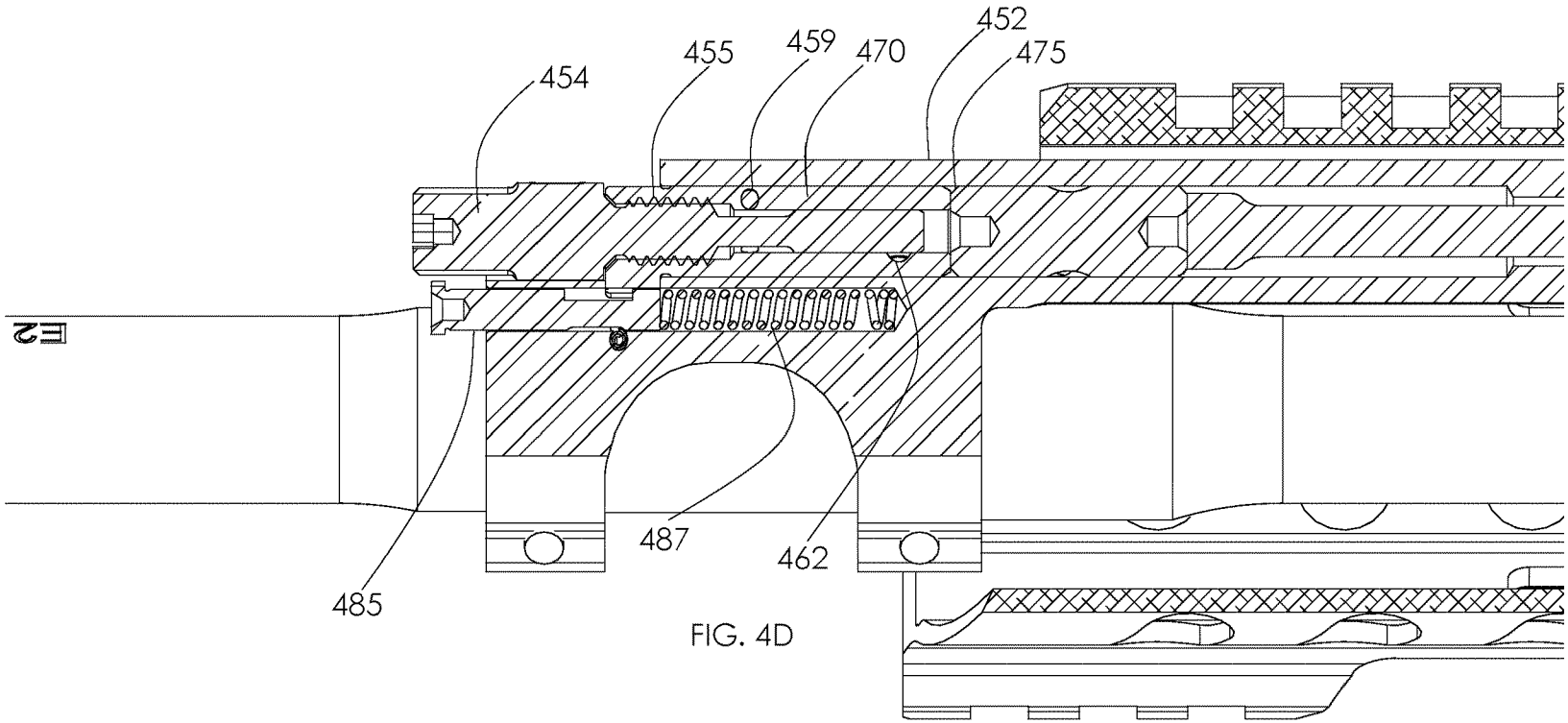
FIG. 4D is a side, cross-sectional view of a portion of an AR-15 style rifle comprising an adjustable gas block, in accordance with various embodiments.

In various embodiments and with reference to FIG. 3C-FIG. 3D, operating system 350 may comprise an adjustment 354 that is retained in body 352 by pin 359. Adjustment 354 may be adjustable between one or more notches 358 that are configured to selectably engage a ball 353 loaded by a spring 351. In this regard, ball 353 may engage one or more notches 358 as adjustment 354 is rotated along threaded portion 355. The rotation and position change of adjustment 354 may change the flow of gas through body 352 and into gas tube 332 (e.g., in a direct impingement operating system). Moreover, adjustment 354 may be configured with a nipple 365 that is configured to engage gas tube 332 and block the flow of gas. In this regard, adjustment may be configured to inhibit the flow of gas in two ways in a closed configuration. More specifically, adjustment 354 may be configured to block gas port 362 and seal gas tube 332.

In various embodiments, the operating systems described herein may be used in any suitable piston operating system or direct impingement operating system where the variation of gas pressure and volume may be used to affect the cycling rate of an AR-15 style firearm.

In various embodiments and with reference to FIG. 4A-FIG. 4D, an operating system 450 for a piston driven rotating bolt rifle is provided (e.g., a piston driven AR-15 style rifle). Operating system may be an adjustable gas system that is configured to operate the piston system.

In various embodiments, operating system 450 may comprise adjustment 454 housed within a plug 470. Adjustment 454 may comprise threaded portion 455. Threaded portion 455 may engage a portion of plug 470. Moreover, adjustment 454 and plug 470 may form an adjustment assembly that is installable in body 452. The adjustment assembly may be retained in body 452 with pin 459. Adjustment 454 may be removable from plug 470 providing for clean out capability.

In various embodiments, adjustment 454 may be partially retained by a retention assembly. The retention assembly may comprise a retention rod 485 and a spring 487. Retention rod 485 may be configured to restrain movement of adjustment 454 in a first position (e.g., an elongated position). Retention rod 485 may be depressed or compressed into body 452 in response to compressing spring 487. In this regard, retention rod 485 may be moved to allow adjustment 454 to be rotated.

In various embodiments, adjustment 454 may be selectably rotated between various notches 458. Each of the various notches 458 may be separately engagable by spring detent assembly 456. Each of the positions associated with the various notches 458 may correspond to a pressure associate with an orifice size corresponding to the relative of position of adjustment 454 to gas port 462.

In various embodiments and in operation, adjustment 454 may be rotated to a particular position to create an operational pressure for an operating configuration (e.g., normal operation, suppressed operation, operation with sub-sonic ammunition, operation with high pressure ammunition, and/or the like). Gas may travel into body 452 through gas port 462. The gas may engage and actuate a piston 475 to contact and actuate op-rod 480. Op-rod 480 may contact or impact the bolt carrier causing the bolt carrier to travel from a battery position to an out of battery position.

Benefits, other advantages, and solutions to problems have been described herein with regard to specific embodiments. Furthermore, the connecting lines shown in the various figures contained herein are intended to represent various functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A rotating bolt firearm, comprising:

an upper receiver;

a bolt installable in the upper receiver and moveable between a first position and a second position;

a barrel comprising an internal chamber operatively coupled to the upper receiver, the barrel configured to receive a forward portion of the bolt;

a gas tube; and an operating system comprising:

a body comprising a gas port fluidly connecting the internal chamber of the barrel to an internal chamber of the body;

an adjustment comprising a threaded portion configured to engage the body, the adjustment comprising a plurality of notches extending forward out of the body, the adjustment configured to block the gas port at an interface between the gas port and the internal chamber of the body, thus preventing flow of gas from the internal chamber of the barrel into the internal chamber of the body, wherein the adjustment comprises a nipple configured to engage the gas tube at an interface between the internal chamber of the body and the gas tube and block flow of gas from the internal chamber of the body into the gas tube;

a pin inserted through a side of the body, wherein the pin is configured to retain the adjustment within the internal chamber of the body; and a spring loaded detent assembly comprising a ball loaded by a spring, wherein the ball is configured to selectively engage one of the plurality of notches in response to rotating the adjustment, wherein the operating system is configured to adjustably vary a gas pressure in the operating system.

2. The rotating bolt firearm of claim 1, further comprising a retention rod located at least partially within the body, wherein the retention rod is configured to restrain movement of the adjustment.

3. The rotating bolt firearm of claim 2, further comprising a spring located within the body and contacting the retention rod.

4. The rotating bolt firearm of claim 3, wherein the retention rod is configured to compress the spring.

5. The rotating bolt firearm of claim 1, wherein the adjustment and a plug form an assembly, wherein the assembly is removable from the body.

6. The rotating bolt firearm of claim 5, wherein the assembly is retained in the body with a pin.

7. The rotating bolt firearm of claim 1, wherein the adjustment and the gas tube are coaxial.

8. The rotating bolt firearm of claim 1, wherein the adjustment and the gas tube are parallel.

9. The rotating bolt firearm of claim 1, wherein the gas tube is parallel to the barrel, and wherein the nipple is located at least partially within the gas tube.

10. The rotating bolt firearm of claim 1, wherein the adjustment inhibits flow of gas at a first location and a second location.

11. The rotating bolt firearm of claim 10, wherein the first location is the interface between the gas port and the internal chamber of the body, and wherein the second location is the interface between the internal chamber of the body and the gas tube.

12. The rotating bolt firearm of claim 1, wherein the adjustment is configured to translate parallel to the barrel.

13. The rotating bolt firearm of claim 1, wherein the adjustment is configured to be adjusted by a user grasping the notches and rotating the adjustment.

14. The rotating bolt firearm of claim 1, wherein the nipple is located within a forward end of the gas tube.

15. The rotating bolt firearm of claim 1, wherein the nipple is configured to translate parallel to the gas tube in order to block flow of gas from the internal chamber of the body to the gas tube.

* * * * *